United States Patent [19]

Pennock

[11] Patent Number: 4,813,593

[45] Date of Patent: Mar. 21, 1989

[54] CONTINUOUS BUSINESS FORM ASSEMBLY OF MAILER UNITS INCLUDING DETACHMENT SLITS

[75] Inventor: Thomas G. Pennock, North Tonawanda, N.Y.

[73] Assignee: Moore Business Forms, Inc., Grand Island, N.Y.

[21] Appl. No.: 506,679

[22] Filed: Jun. 22, 1983

[51] Int. Cl.[4] ..... B65D 27/10

[52] U.S. Cl. ..... 229/69; 206/820; 225/106

[58] Field of Search ..... 229/69, 68 R, ; 493/198, 203, 204, 222, 238; 53/389, 385; 225/106, 100, 101; 206/820

[56] References Cited

U.S. PATENT DOCUMENTS

| | | | |
|---|---|---|---|
| 2,874,886 | 2/1959 | Piazze | 225/106 |
| 3,098,594 | 7/1963 | Williamson | 225/106 |
| 3,268,136 | 8/1966 | Huffman | 206/820 |
| 4,012,268 | 3/1977 | Johnson | 229/69 X |
| 4,380,315 | 4/1983 | Steidinger | 229/69 |
| 4,453,649 | 6/1984 | Origuchi | 206/559 X |

*Primary Examiner*—Jimmy G. Foster
*Assistant Examiner*—Bryon Gehman
*Attorney, Agent, or Firm*—Allegretti & Witcoff, Ltd.

[57] ABSTRACT

A continuous business form assembly of mailer units, the units of which have slits for accommodating breaker knuckles used in the detaching operation.

1 Claim, 1 Drawing Sheet

CONTINUOUS BUSINESS FORM ASSEMBLY OF MAILER UNITS INCLUDING DETACHMENT SLITS

BACKGROUND OF THE INVENTION

This invention relates to a continuous business form assembly, and more particularly, to continuous business form assembly of readily detached, easy opening mailer units or envelopes.

In the art of continuous business form assemblies, the automatic and manual handling of form assemblies and individual forms have presented many problems. Significant among such problems is automatic detachment of the individual forms from continuous form assemblies. The problem is especially acute with continuous form assemblies having perforation lines on the individual forms parallel to and adjacent the perforation lines intended for forms detachment. With certain automatic detachers or bursters, these forms are to be detached from each other, or burst, through tension and breaker knuckles. The knuckles are to perforate a select one or few of the perforations of a line, and the tension is to cause the perforation begun by the knuckles to continue along the line. With such forms and bursters, form registry with the breaker knuckles has been critical. Lack of registry has caused breakage of the perforation lines other than the lines intended for form detachment. This breakage has ruined up to one form for every fourteen forms being handled. In the past, attention to the problem has focused on machine modification, involving great expense and little success.

SUMMARY OF THE INVENTION

An object of the inventor of this invention was to provide a less expensive, successful solution to the problem of form breakage over breaker knuckles. The inventor discovered that suprisingly, instead of expensive machine modifications, the problem can be solved by a continuous business form assembly of mailer units or envelopes, the units of which are readily, automatically detached without form destruction, in unmodified machines which otherwise destroy many forms.

In a principal aspect, then, the present invention is an assembly, the mailing units of which have slits at preselected locations to accommodate breaker knuckles of automatic detachers.

BRIEF DESCRIPTION OF THE DRAWING

The accompanying drawing consists of one figure, briefly described as a face view of a preferred continuous web of the present invention.

In the description and claim which follow, directional terms such as "upper", "lower", "right" and "left" are used. These terms are an aid to understanding this disclosure, the drawing, and the claim in relation to each other. Their use in the claim should be understood to be for the purpose of identification, rather than limitation to any specific spatial orientation of the forms of the invention.

DETAILED DESCRIPTION OF THE PREFERRED EMBODIMENT

Figure 1:
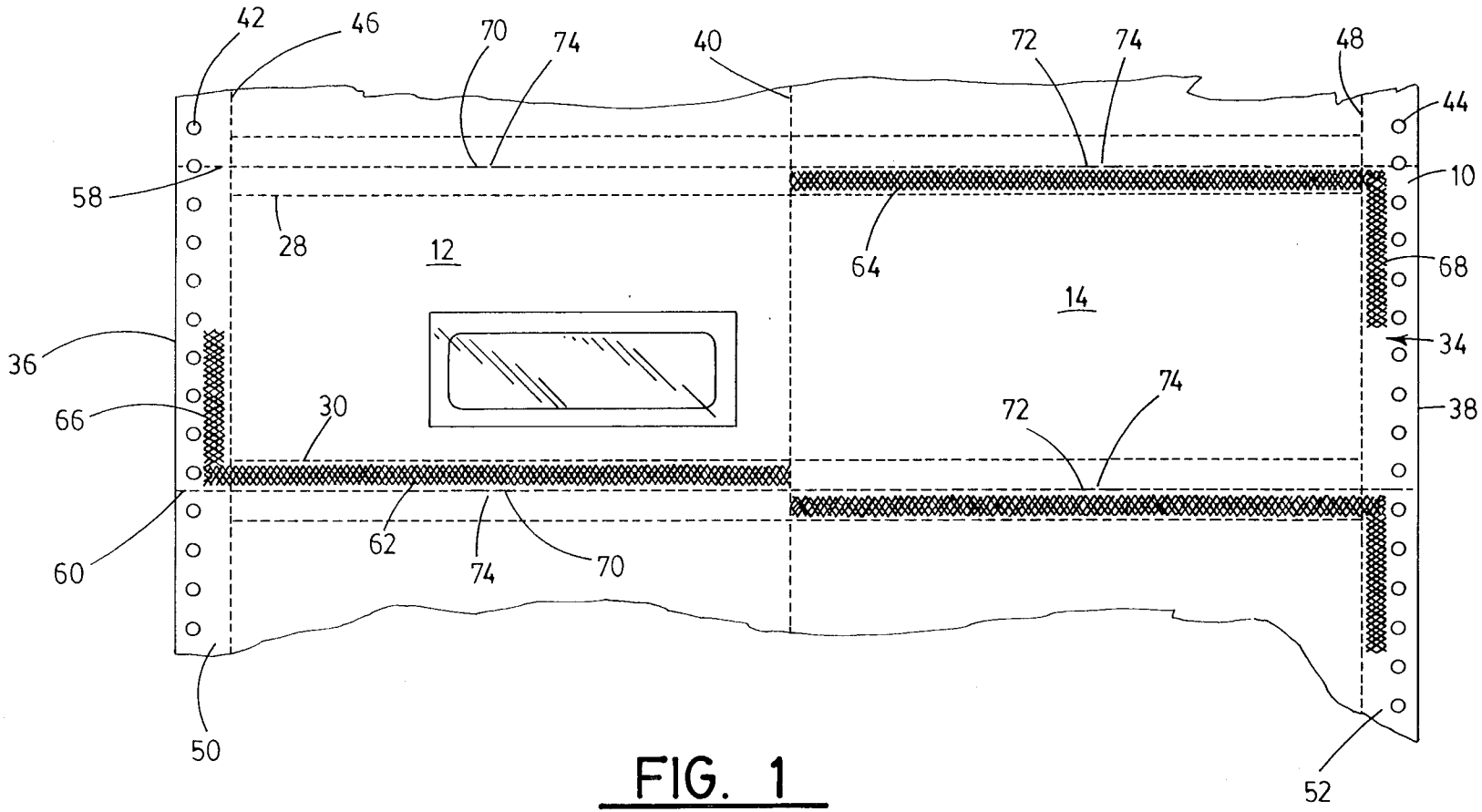

Referring to the drawing, the preferred embodiment of the present invention includes a continuous business form assembly of one continuous web 34. Mailer units 10 are formed in a continuous series on the web 34.

The web 34 is continuous in a longitudinal (vertical, in FIG. 1) direction. In a transverse (horizontal, in FIG. 1) direction, the assembly 34 extends from a first, longitudinally extending side edge 36 to a second, longitudinally extending side edge 38. A first, longitudinally extending row 42 of spaced feed holes extend parallel to and adjacent the first side edge 36. A second, longitudinally extending row 44 of spaced feed holes extend parallel to and adjacent the second side edge 38. The row 44 is at the same distance from the side edge 38 as the row 42 is from the side edge 36.

Adjacent the row 42 is a longitudinally extending marginal or feed strip perforation line 46; adjacent the row 44 is a longitudinally extending marginal or fed strip perforation line 48. The perforation line 46 extends along and parallel to the row 42, while the perforation line 48 extends along and parallel to the row 44. The perforation lines 46, 48 define marginal feed strips 50, 52, respectively, along the web 34. The distance from the perforation line 46 to the side edge 36 is equal to the distance from the perforation line 48 to the side edge 38.

At the transverse center of the assembly 34, a plow fold 40 in the form of a plow fold perforation line divides the assembly 34 transversely front and back panels 12, 14. Thus, if the assembly 34 or a form unit 10 thereof is folded along the plow fold line 40, the edge 36 overlies the edge 38 and the row 42 overlies the row 44. The line 46 overlies the line 48.

The assembly 34 further includes at least two transversely extending, longitudinally spaced, mailer-unit forming or detachment perforation lines 58, 60, The lines 58, 60 extend across the assembly 34. The perforation lines 58, 60 provide for detachment of a mailer unit 10 from the assembly 34, and together with the lines 46, 48, 40 define the periphery of the front and back panels 12, 14 of the unit 10.

The panels 12, 14 are rectangular and formed side-to-side in the assembly 34.

Pairs of two opening perforation lines 28, 30 are located on the assembly 34, in the panels 12, 14. The first or upper opening perforation line 28 parallels and is adjacent the detachment perforation line 58, extending from the feed strip perforation line 46 to the feed strip perforation line 48. The second or lower opening perforation line 30 parallels and is adjacent the detachment perforation line 60, also extending between the perforation lines 46, 48.

Adhesive lines 62, 64 cross the assembly 34 transversely from the feed strip 50, 52, respectively, across the panels 12, 14, respectively, to the plow fold line 40. The adhesive lines 62, 64 parallel the detachment perforation lines 60, 58; are respectively adjacent such lines 60, 58; and are at distances therefrom less than the distance of the opening perforation lines 28, 30 from the detachment perforation lines 58, 60. The adhesive lines 62, 64 are joined in the feed strips 50, 52 by longitudinal adhesive lines 66, 68 which extend at least substantially halfway between the detachment perforation lines 58, 60.

If the assembly 34 is folded along the plow fold 40, the adhesive lines 62, 64, 66,68 are positioned to adhere the panel 14 to the panel 12, and the strip 50 to the strip 52, thereby forming the envelopes 10 of the panels 12, 14 and strips 50, 52.

As shown, the detachment perforation lines 58, 60 are each interrupted at two locations by detachment slits 70, 72. The slits 70, 72 are equidistant from the plow fold line 40, about five-eights inch in length, and about halfway between the plow fold line 40 and the side edges 36, 38. Each slit 70, 72 includes a "microtie"—or tie of reduced, and substantially reduced strength when compared with the other ties of the perforation lines 58, 60—74 at its center. When the assembly 34 is plow-folded, the slits 70, 72 overlie each other. The slits 70, 72 then align with the breaker knuckle on a detacher, and eliminate breakage of the mailer unit perforation lines 28, 30.

As should now be apparent, the units 10 are formed from the assembly 34 by (a) folding of the assembly 34 along the plow fold line 40, (b) adherence of the adhesive lines 62, 64, 66, 68 to the panels 12, 14 and strips 50, 52, and (c) detachment of the units 10 from the assembly 34 along the detachment perforation lines 58, 60. The units 10 then are ready for use and mailing.

Should information be desired in the units 10, the contents can be imaged by a computer on the assembly 34 before folding and the adherence of the lines 62, 64, 66, 68 to the panels 12, 14 and strips 50, 52 seals the unit 10 closed. After mailing, the unit 10 can be opened and the information revealed.

The invention of this disclosure and the manner and process of making and using it are now described in such full, clear, concise and exact terms as to enable any person skilled in the art to make and use the same. The best mode contemplated by the inventor of carrying out his invention is set forth.

To particularly point out and distinctly claim the subject matter regarded as invention, the following claim conclude this specification.

What is claimed is:

1. A continuous paper business form assembly of individual mailer units, comprising a longitudinally continuous paper web, and having the following:

a longitudinally extending first side edge, a transversely spaced, longitudinally extending second side edge, a first, longitudinally extending row of spaced feed holes along and adjacent the first side edge.

a second, longitudinally extending row of spaced feed holes along and adjacent the second side edge, a longitudinally extending, transversely centered plow fold, a plurality of longitudinally spaced, detachment perforation lines extending transversely across the assembly and defining the individual mailer units, a longitudinally extending, first marginal perforation line along and adjacent the first row of spaced feed holes and defining a first marginal feed strip along the first side edge, a longitudinally extending, second marginal perforation line along and adjacent the second row of spaced feed holes and defining a second marginal feed strip along the second side edge, a plurality of first mailer unit panels extending longitudinally between the longitudinally spaced, detachment perforation lines and extending transversely between the first side edge and the plow fold, a plurality of second mailer unit panels extending longitudinally between the longitudinally spaced, detachment perforation lines and extending transversely between the plow fold and the second side edge, a plurality of upper and lower opening perforation lines on the first and second mailer unit panels extending transversely between the longitudinally extending, first and second marginal perforation line, the upper opening perforation lines being along and adjacent the detachment perforation lines, and the lower opening perforaton lines being along and adjacent the detachment perforation lines opposite the upper opening perforation lines, a plurality of first detachment slits and a plurality of second detachment slits, the first detachment slits each interrupting one of the detachment perforation lines at a preselected distance from the plow fold between the plow fold and the first side edge, the second detachment slits each interrupting one of the detachment perforation lines at the preselected distance from the plow fold between the plow fold and the second side edge, each first detachment slit and each second detachment slit having a center and each having a microtie at each center, the first detachment slits overlying the second detachment slits when the web is folded along the plow fold, and accommodating a breaker knuckle of a form detacher, and the web being foldable along the plow fold, the mailer units being separable from the web by perforation of the detachment perforation lines, and the mailer unit thereby being placable in mailing condition.

* * * * *